US008126189B2

(12) United States Patent
Liou et al.

(10) Patent No.: US 8,126,189 B2
(45) Date of Patent: Feb. 28, 2012

(54) MULTI-DIRECTIONAL FLAT SPEAKER DEVICE

(75) Inventors: Chang-Ho Liou, Changhua County (TW); Kuo-Hua Tseng, Taipei County (TW); Ming-Daw Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 309 days.

(21) Appl. No.: 12/472,379

(22) Filed: May 27, 2009

(65) Prior Publication Data

US 2010/0208932 A1 Aug. 19, 2010

(30) Foreign Application Priority Data

Feb. 13, 2009 (TW) ..... 98104651 A

(51) Int. Cl.

| | |
|---|---|
| ***H04R 1/00*** | (2006.01) |
| ***H04R 11/02*** | (2006.01) |
| ***H04R 9/06*** | (2006.01) |
| ***H04R 1/02*** | (2006.01) |
| ***H04R 25/00*** | (2006.01) |

(52) U.S. Cl. ..... 381/431; 381/152; 381/338; 381/387

(58) Field of Classification Search ..... 381/152, 381/338, 431, 387

See application file for complete search history.

(56) References Cited

U.S. PATENT DOCUMENTS

| | | | | |
|---|---|---|---|---|
| 3,894,199 | A | 7/1975 | Tamura et al. | |
| 4,073,365 | A * | 2/1978 | Johnson | 181/147 |
| 4,700,396 | A * | 10/1987 | Bolin | 381/97 |
| 6,069,962 | A * | 5/2000 | Miller | 381/300 |
| 6,215,883 | B1 * | 4/2001 | Leonarz | 381/182 |
| 6,411,718 | B1 * | 6/2002 | Danley et al. | 381/342 |
| 6,546,106 | B2 * | 4/2003 | Azima | 381/152 |
| 6,961,438 | B1 * | 11/2005 | Fujita | 381/182 |
| 7,010,143 | B2 * | 3/2006 | Kam | 381/426 |
| 7,764,804 | B2 * | 7/2010 | Ohta et al. | 381/190 |
| 7,769,191 | B2 * | 8/2010 | Lee et al. | 381/152 |
| 2005/0244025 | A1 * | 11/2005 | Schul et al. | 381/334 |
| 2005/0254674 | A1 | 11/2005 | Huang et al. | |
| 2005/0286730 | A1 * | 12/2005 | Pazandeh | 381/182 |
| 2007/0025588 | A1 * | 2/2007 | Bachmann et al. | 381/431 |
| 2007/0092092 | A1 * | 4/2007 | Kondo et al. | 381/152 |
| 2008/0107291 | A1 * | 5/2008 | Livingston | 381/152 |

(Continued)

FOREIGN PATENT DOCUMENTS

JP 2008099062 A * 4/2008

(Continued)

*Primary Examiner* — Ida M Soward

(74) *Attorney, Agent, or Firm* — Jianq Chyun IP Office

(57) ABSTRACT

A multi-directional flat speaker device is disclosed. By the directional characteristics of a plurality of flat speakers of the flat speaker device, accompanying with mechanism to actuate each of the plurality of flat speakers independently rotating to its desired direction, a composite sound field is generated as desired accordingly. The design makes the applications of the flat speaker device more suitable to meet the requirement of future utilizations. The mechanism to actuate the plurality of flat speakers can be achieved by controlling one or more of the flat speakers to rotate in a unique manner. The mechanism can control a facing angle of any one of the plurality of flat speakers independently. The mechanism can be designed by mechanical or electrical controlling manner.

15 Claims, 12 Drawing Sheets

U.S. PATENT DOCUMENTS

| | | | | |
|---|---|---|---|---|
| 2008/0212805 | A1* | 9/2008 | Fincham | 381/160 |
| 2008/0304692 | A1* | 12/2008 | Zhang | 381/387 |
| 2009/0016551 | A1 | 1/2009 | Chiang et al. | |
| 2009/0060233 | A1 | 3/2009 | Liou et al. | |
| 2009/0060234 | A1 | 3/2009 | Liou et al. | |
| 2009/0060249 | A1 | 3/2009 | Liou et al. | |
| 2009/0067648 | A1 | 3/2009 | Liou et al. | |
| 2009/0214049 | A1 | 8/2009 | Lee et al. | |
| 2009/0272037 | A1* | 11/2009 | Sosa | 49/74.1 |
| 2009/0304212 | A1 | 12/2009 | Han et al. | |
| 2010/0024198 | A1 | 2/2010 | Chen et al. | |
| 2010/0027814 | A1 | 2/2010 | Chen et al. | |

FOREIGN PATENT DOCUMENTS

| | | |
|---|---|---|
| TW | I264960 | 10/2006 |
| TW | I293233 | 2/2008 |
| TW | I294250 | 3/2008 |
| TW | 200939860 | 9/2009 |

* cited by examiner

Rotating to different angles (0–360) through the revolver

Rotating to different angles (0–180) through the revolver

MULTI-DIRECTIONAL FLAT SPEAKER DEVICE

CROSS-REFERENCE TO RELATED APPLICATION

This application claims the priority benefit of Taiwan application serial no. 98104651, filed on Feb. 13, 2009. The entirety of the above-mentioned patent application is hereby incorporated by reference herein and made a part of this specification.

BACKGROUND OF THE INVENTION

1. Technical Field

The disclosure relates to a speaker device. More particularly, relates to a multi-directional flat speaker device.

2. Background

The two most direct sensory systems of human being are visual and audible systems, so for a long time, scientists try their best to develop related elements or system techniques. The demand of providing the user with more plentiful or specific sound fields by utilizing the composition of speaker system will be consistent in the future market application. Recently, electro-acoustic speakers are mainly classified into direct and indirect radiating types, and are approximately classified into moving coil, piezoelectric, and electrostatic speakers according to driving manners. The moving coil speaker is currently the most commonly used and most mature product. However, a moving coil speaker cannot be compressed due to the physical structure thereof. Accordingly, moving coil speaker is not suitable for 3C products and home entertainment systems which have their sizes reduced constantly. A piezoelectric speaker pushes a membrane to produce sounds based on the piezoelectric effect of an electrical material (i.e., the material is deformed when an electric field is supplied thereon). Although having a compressed and small structure, the piezoelectric speaker can not be flexible as the electrical material requires sintering.

Currently, the manufacture of speakers still applies the design production method as that for a single unit as illustrated in U.S. Pat. No. 3,894,199.

As for the electrostatic speaker, for example, in U.S. Pat. No. 3,894,199, an electro-acoustic transducer structure is mainly provided, as shown in FIG. 1. The structure includes two fixed electrode structures 110 and 120 placed on two sides. The fixed electrode structures 110 and 120 have a plurality of pores for scattering the sounds generated. A vibrating film 130 is disposed between the fixed electrode structures 110 and 120. A fixing structure 140 is made of an insulation material, and used to fix the fixed electrode structures 110 and 120 and the vibrating film 130. The fixed electrode structures 110 and 120 are respectively connected to an AC source 160 through a transformer 150. When an AC signal is transmitted to the fixed electrode structures 110 and 120, a potential is alternately changed to enable the vibrating film 130 to generate vibration due to difference potentials on two sides thereof, and thereby generating corresponding sound. However, the above configuration needs to enhance the sound-pressure output, so an additional power element is required to work together with the driving process. In this manner, the apparatus not only has a large volume, but more elements are used, and the cost is also relatively high. In addition, the fixing structure 140 must fix the fixed electrode structures 110 and 120 and the vibrating film 130, so the electro-acoustic transducer structure cannot achieve the flexible characteristics.

SUMMARY

The embodiment is a multi-directional flat speaker device, which includes a plurality of speakers having directional effects, a control mechanism, and a serial connection device. The speakers with directional effects can transmit sounds to appointed locations. The control mechanism is directed to control the rotation angles of the speakers having directional effects. The serial connection device is directed to connect the speakers having directional effects.

In one embodiment, the multi-directional flat speaker device includes a plurality of flat speakers with sound field directional characteristics, a serial connection mechanism, and a control mechanism. The serial connection mechanism is configured to connect the flat speakers serially in a parallel manner. The control mechanism controls one or more of the flat speakers to rotate respectively, and generates a directional sound field according to the rotation angle of the flat speaker.

In the multi-directional flat speaker device, wherein the control mechanism independently actuates each of the flat speakers to rotate a corresponding angle thereof, or actuates all of the flat speakers to rotate a same angle.

In the multi-directional flat speaker device, wherein the control mechanism drives the serial connection mechanism to rotate through a transmission belt. The control mechanism can apply the mechanical or electrical controlling manner.

The multi-directional flat speaker device, wherein the flat speakers are connected to an audio input interface for receiving at least one or a plurality of set(s) of audio signal inputs, and transmitting the foregoing audio signals to the corresponding flat speakers.

In the multi-directional flat speaker device, wherein the audio input interface receives a plurality of processed divided signals and transmits the processed divided signals to each of the appointed speakers with directional effects through the serial connection mechanism. Afterward, the control mechanism is utilized in cooperation to drive each of the flat speakers for transmitting the processed divided signals, which is obtained from the audio input interface, to a specific direction.

BRIEF DESCRIPTION OF THE DRAWINGS

The accompanying drawings are included to provide a further understanding of the embodiment, and are incorporated in and constitute a part of this specification. The drawings illustrate embodiments and, together with the description, serve to explain the principles of the embodiment.

DESCRIPTION OF EMBODIMENTS

Figure 1:
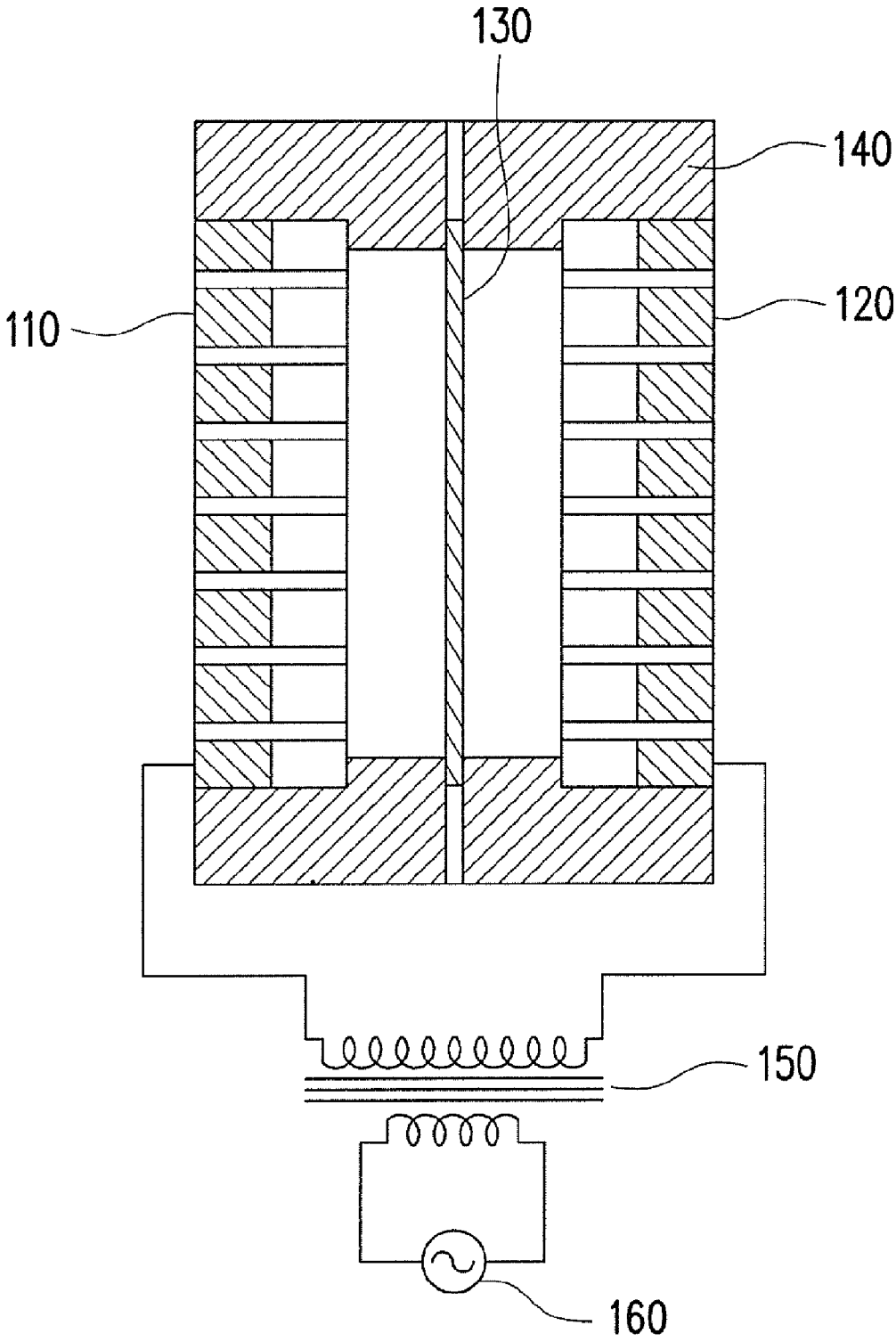
FIG. 1 (RELATED ART)
FIG. 1 illustrates an electro-acoustic transducer structure.

The electrostatic speaker includes mainly Hi-End earphone and loudspeaker in the current market. The operating principle for the conventional electrostatic speaker is that two fixed electrode plates with holes are used to clamp a conductive vibrating film to form a capacitor, and then a DC bias is applied to the vibrating film and an AC voltage is applied to two fixed electrodes, and electrostatic force generated by the positive and negative electric fields is used to drive the conductive vibrating film to vibrate and to radiate sounds. The basic structure of the thin-type flat speaker technology has a characteristic of being high directional, and this characteristic can be applied in the design of sound fields.

In one embodiment provides that by the sound field directional characteristics of the flat speaker device, accompanied with the external multi-directional control mechanism, a composite sound field is generated as desired accordingly. The design makes the applications of the flat speaker device more suitable to meet the requirement of future utilizations.

The multi-directional control mechanism to actuate the flat speakers can be achieved by controlling one or more of the flat speakers to rotate in a unique manner or independently. The control mechanism can be designed by a mechanical or an electrical controlling manner.

Therefore, in the application of conventional speakers, the flat speakers with directivity can be utilized so as to be apart from the design of conventional speakers. Consequently, the sound components can be utilized in many other application fields, and is becoming a major point in the development of flat speaker techniques.

The multi-directional flat speaker device includes a plurality of speakers having directional effects, a control mechanism, and a serial connection device. The speakers with directional effects can transmit sounds to preset locations. The control mechanism, such as a control unit, is directed to control the rotation angles of the speakers having directional effects. The serial connection device is directed to connect the speakers having directional effects. The audio input interface is configured to receive the external audio signal inputs.

In the multi-directional flat speaker device, wherein the control mechanism can control the speakers with directional effects to make sounds at the same direction or individual directions.

In the multi-directional flat speaker device, wherein the serial connection device can be assembled by transmission lines that are sharing transmission audio signals or by applying an external facilitating connection mechanism.

In the multi-directional flat speaker device, wherein the audio input interface can receive one or a plurality of set(s) of audio signals. If the sets of audio signals are inputted, the audio signals can be a plurality of identical signals or a plurality of processed divided signals.

In the multi-directional flat speaker device, if the audio input interface receives the processed divided signals, the signals can be transmitted to each of the preset speakers with directional effects through the serial connection device. Afterward, the control mechanism is utilized in cooperation to drive each of the speakers with directional effects for transmitting the processed divided signals, which is obtained from the audio input interface, to a specific direction.

In the multi-directional flat speaker device of the embodiment, the effect of special sound field is achieved by utilizing the directional characteristics of the flat electrostatic speaker structure. The fundamental principle of the flat electrostatic speaker utilizes the charge characteristics and the electrostatic force effect in the vibrating film material. When the vibrating film is stimulated by an external voltage, the vibrating film surface generates deformation, so as to drive the air around the vibrating film to generate sounds. As known from the electrostatic force formula and energy laws that, the force applied on the vibrating film equals to the capacitance value of the whole speaker multiplied by the intensity of the internal electric field and the externally-inputted sound voltage signal, and the larger the force applied on the vibrating film is, the louder the outputted sound is.

Figure 2A:
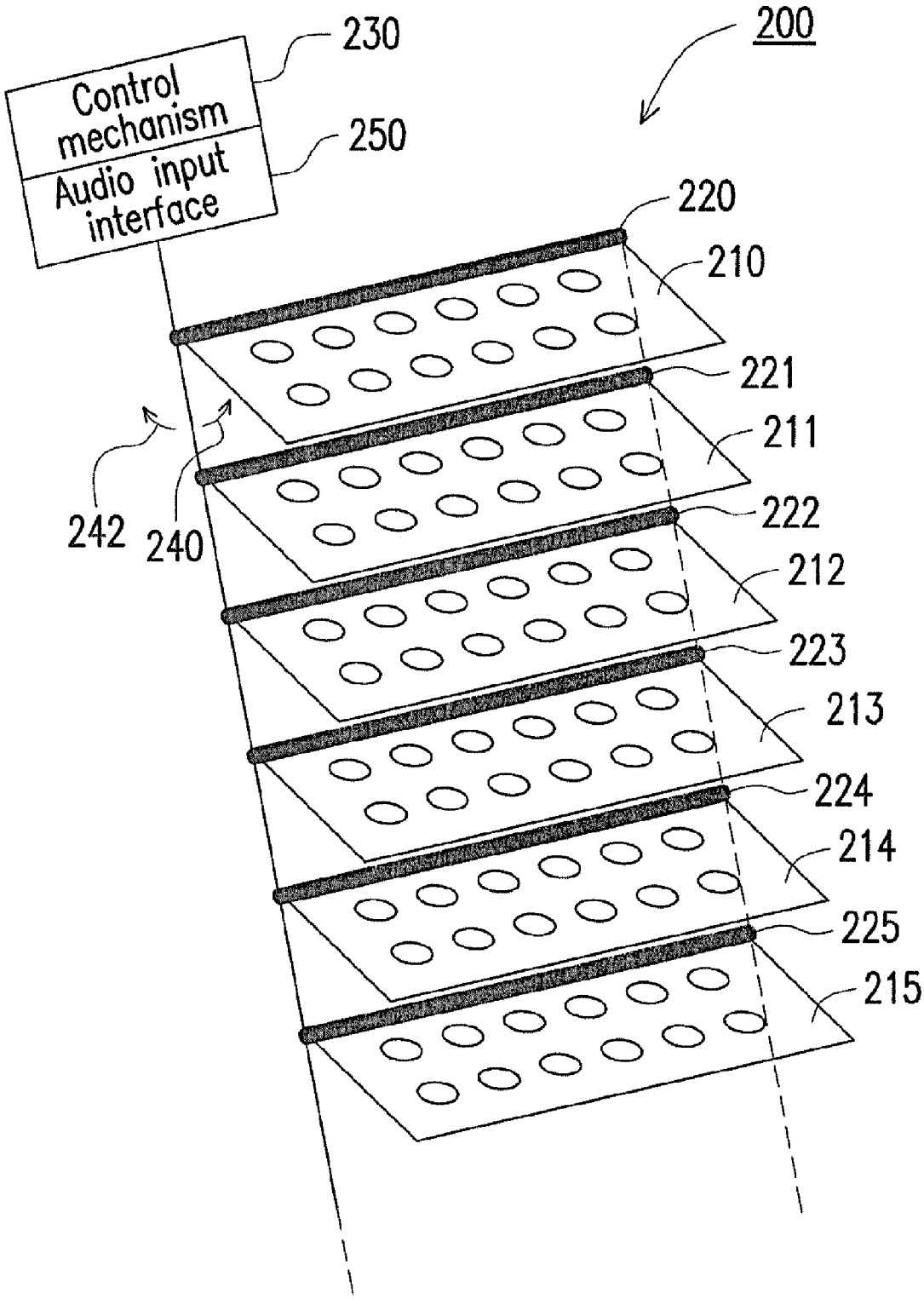
FIG. 2A is a schematic structural diagram of a multi-directional flat speaker device according to an embodiment of the embodiment.
Figure 2B:
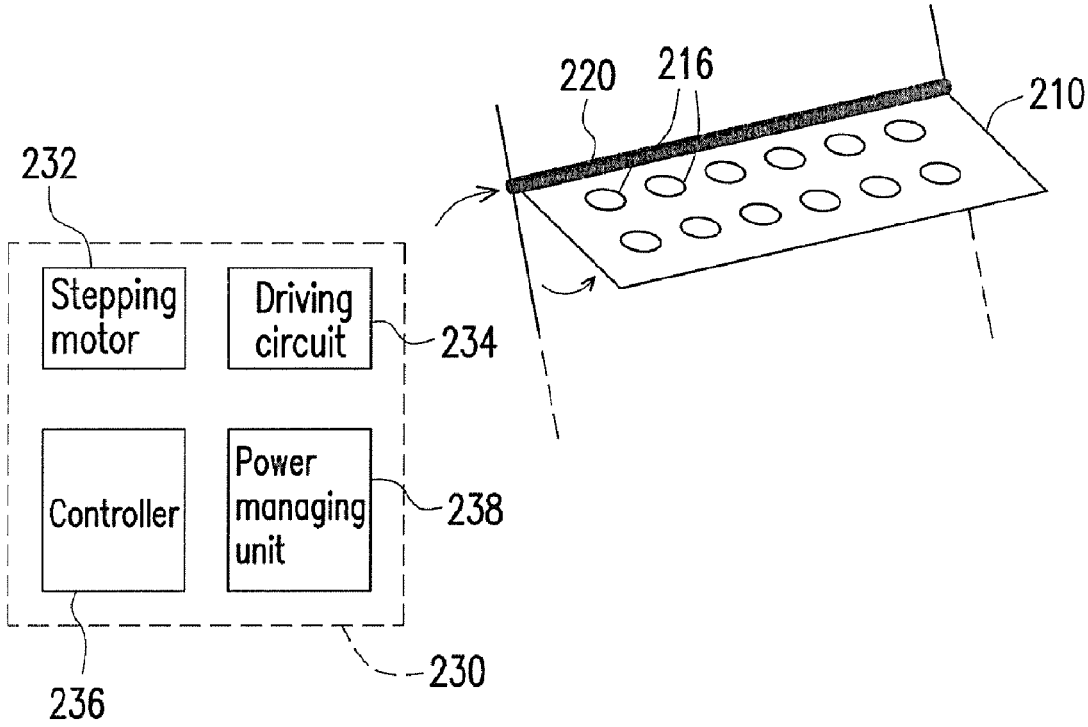
FIG. 2B is a schematic structural diagram of a control mechanism of the multi-directional flat speaker device in FIG. 2A.
Figure 2C:
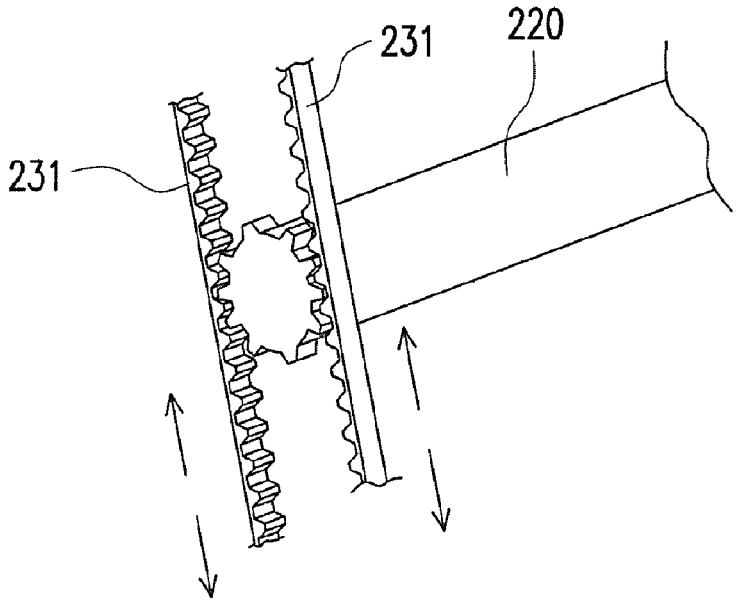
FIG. 2C is a schematic diagram of a method of driving a stepping motor of the multi-directional flat speaker device in FIG. 2A.

On the other hand, the moving coil speakers can not apply multiple sets of moving coil speakers within a suitable area for achieving the sound directional effect. Hence, the embodiment provides diagrams as illustrated in FIGS. 2A~2C, which the speakers are assembled with a structure similar to that of the shutters. As illustrated in FIG. 2A, a multi-directional flat speaker device includes a plurality of flat speakers with directional effects 210, 211, 212, 213, 214, and 215, and the surfaces thereof include a plurality of sound holes. A serial connection mechanism, for example, a plurality of serial connection devices 220, 221, 222, 223, 224, and 225 as illustrated in the diagrams, is configured to serially connect the flat speakers 210, 211, 212, 213, 214, and 215 in a parallel manner, so as to drive the serially connected flat speakers to rotate in a direction 240 or an opposite direction 242. A control mechanism 230 is configured for driving the serial connection devices 220, 221, 222, 223, 224, and 225 to rotate. Moreover, an audio input interface 250 can receive one or a plurality of set(s) of audio signals from an external music playing device, and then transmit the audio signals to the flat speakers 210, 211, 212, 213, 214, and 215.

The serial connection mechanism is driven by a control mechanism, and is configured to actuate the flat speakers to individually rotate in the same direction or different directions. The control mechanism can be achieved by a method of assembling an electrical circuit and a mechanical mechanism. In one embodiment, a method of assembling a simple mechanical mechanism, for example, applying a structure similar to the structures of shutters that are pulled manually, can be used. In addition, a method of linking serial connected thin-type flat speakers is to apply transmission lines for transmitting audio signals or an external facilitating mechanism.

Referring to FIG. 2B, a schematic diagram of the control mechanism in one embodiment is illustrated. The control mechanism 230 includes a stepping motor 232, a driving circuit 234, a controller 236, and a power managing unit 238. The stepping motor 232 is configured for driving the serial connection devices 220, 221, 222, 223, 224, and 225 to rotate. The driving circuit 234 is configured to generate a control signal for driving. Moreover, the controller 236 is configured to calculate and control a rotation angle. The power managing unit 238 provides a power to drive the driving device 230. The driving device 230 drives the serial connection device so that multiple embodiments for rotating the flat speakers are available. In one embodiment, a driving method of the stepping motor 232 can be as illustrated in FIG. 2C, where the serial connection devices 220, 221, 222, 223, 224, and 225 have gear wheels on two sides, and are rotated via a transmission belt 231. The transmission belt 231 is connected to the stepping motor 232 to drive the transmission belt 231 to move up and down, and thereby driving the gear wheels on the two sides of the serial connection devices to rotate.

By controlling the thin-type flat speakers 210, 211, 212, 213, 214, and 215 that are serially connected, the control mechanism 230 can control the serially connected thin-type flat speakers to send sounds in a same direction by using the directional characteristics thereof. Hence, the sound sending location can receive a volume louder than the normal.

In a multi-directional flat speaker device 200, the flat speakers 210, 211, 212, 213, 214, and 215 are connected to an audio input interface 250 for receiving one or a plurality set(s) of audio signals from an external music playing device. If the sets of audio signals are inputted, then the signals can be a plurality of identical signals or a plurality of processed divided signals.

In the multi-directional flat speaker device 200, if the audio input interface receives the processed divided signals, the signals can be transmitted to each of preset speakers with directional effects through the serial connection mechanism. Afterward, the control mechanism is utilized in cooperation to drive each of the speakers with the directional effects for transmitting the processed divided signals of the audio input interface to a specific direction.

Figure 3:
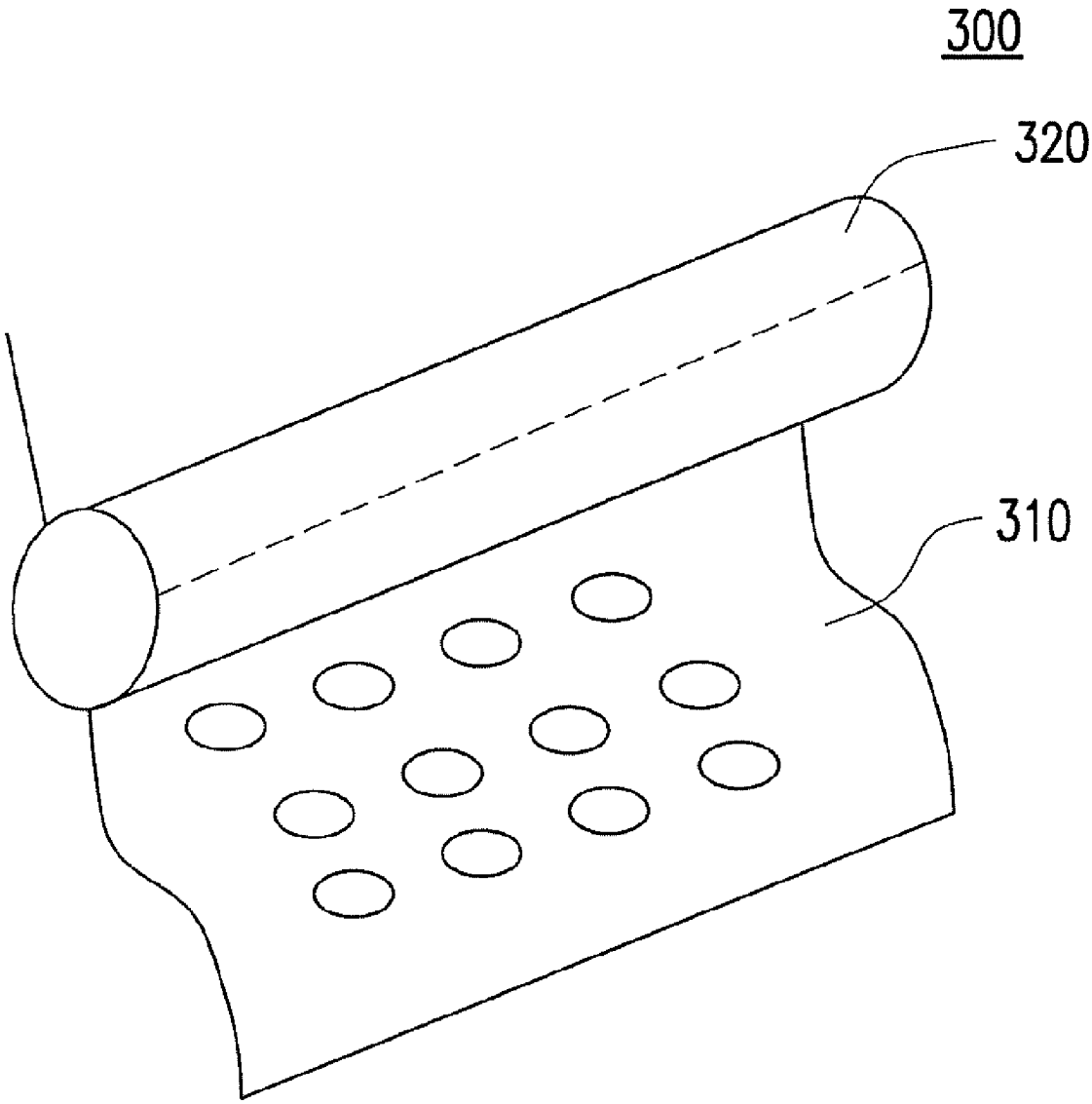
FIG. 3 is a schematic structural diagram of a flat speaker with characteristics of being flexible and the like according to another embodiment of a multi-directional flat speaker device in the embodiment.

In another embodiment of the multi-directional flat speaker device, a flat speaker with characteristics of being light, thin, flexible, and the like can be applied as illustrated in FIG. 3. In a multi-directional flat speaker device 300, a flexible flat speaker 310 can roll up a serial connection device 320. Next, the flexible flat speaker 310 can be rolled out and then adjusts a direction for sending sounds through supporting elements on two ends of the serial connection device 320.

Figure 4:
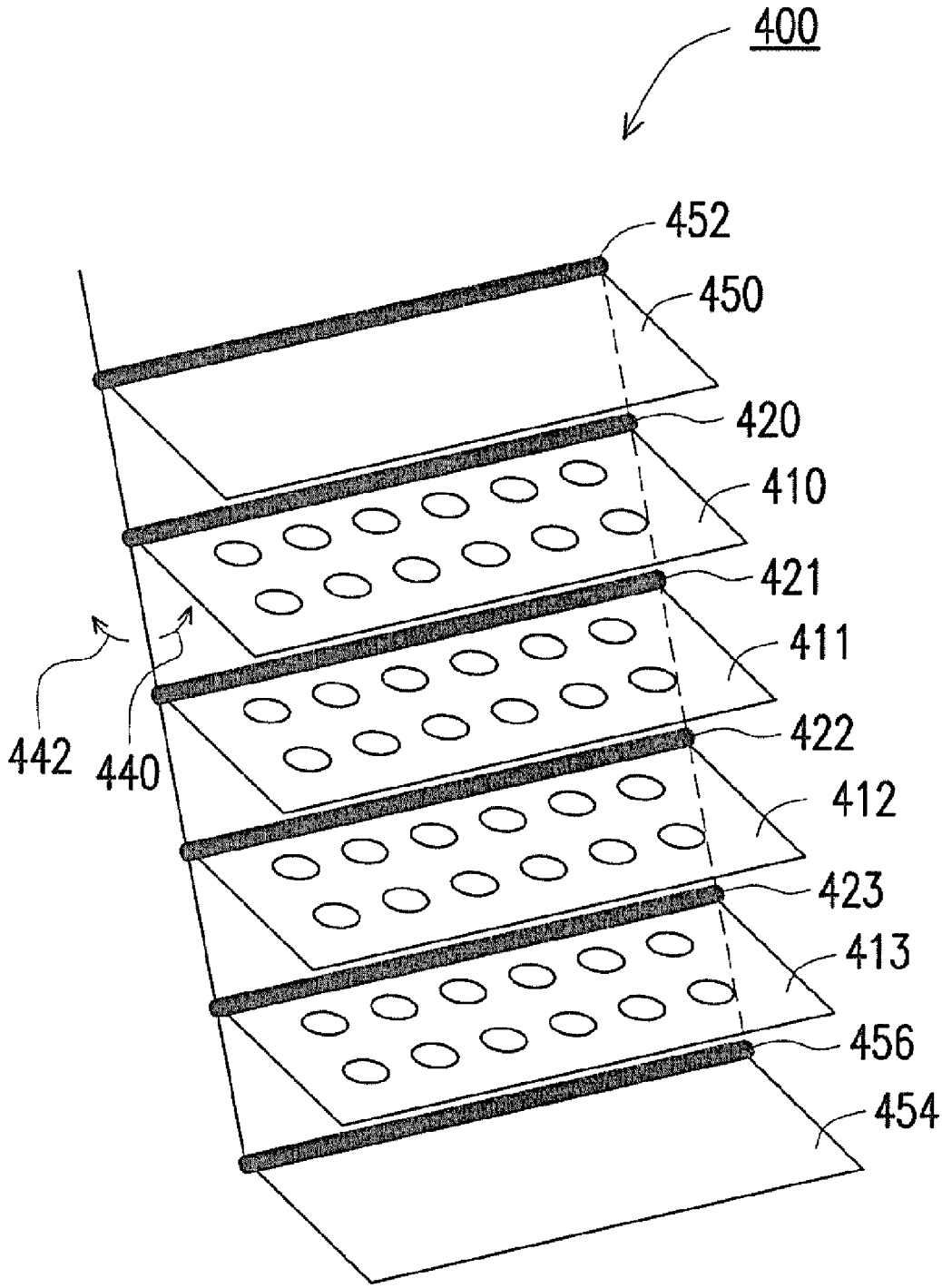
FIG. 4 is a schematic structural diagram of a multi-directional flat speaker device having baffle structures according to another embodiment.

Referring to FIG. 4, according to an embodiment of the multi-directional flat speaker device in the embodiment, a multi-directional flat speaker device 400 includes a plurality of flat speakers with directional effects 410, 411, 412, and 413 as shown in the diagram, for example, where surfaces thereof includes a plurality of sound holes. A plurality of serial connection devices 420, 421, 422, and 423 is serially connected to a plurality of corresponding flat speakers 410, 411, 412, and 413 respectively so as to drive the serially connected flat speakers to rotate in a direction 440 or a direction 442. In order to enhance the directional effects of the flat speakers, increase reflectivity of sounds, or prevent interferences between adjacent speakers, the multi-directional speaker device 400 is joined with baffles 450 and 454 for increasing the sound reflectivity or preventing the interferences between adjacent speakers. The baffles 450 and 454 respectively include serial connection devices 452 and 456 for control mechanisms to control rotations thereof.

Figure 5A:
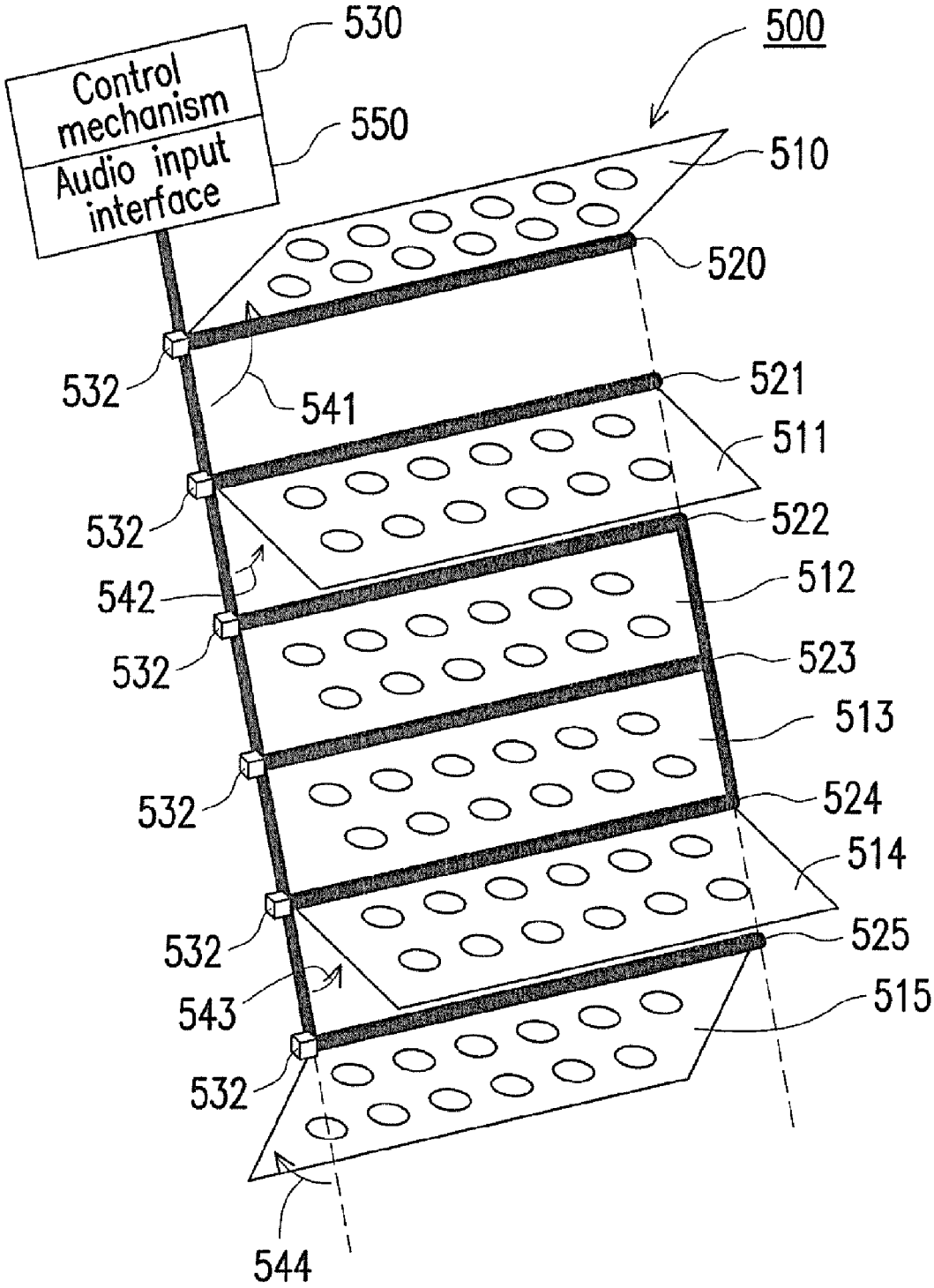
FIG. 5A is a schematic diagram of a multi-directional flat speaker device capable of adjusting angles individually according to another embodiment.

In another embodiment of the multi-directional flat speaker device, a control mechanism can be utilized to control serially connected thin-type flat speakers for sending sounds individually to directions preset by a user. Therefore, audience at different locations can all sense the audio information as required. Referring to FIG. 5A, a multi-directional flat speaker device 500 includes a plurality of flat speakers with directional effects 510, 511, 512, 513, 514, and 515, and surfaces thereof include a plurality of sound holes. A plurality of serial connection devices 520, 521, 522, 523, 524, and 525 is serially connected to the corresponding flat speakers 510, 511, 512, 513, 514, and 515 respectively. A control mechanism 530 is configured for driving the serial connection devices 520, 521, 522, 523, 524, and 525 to rotate. Moreover, an audio input interface 550 can receive one or a plurality of set(s) of audio signals from an external music playing device. The audio input interface 550 then transmits the audio signals to the flat speakers 510, 511, 512, 513, 514, and 515.

The serial connection devices 520, 521, 522, 523, 524, and 525 are respectively driven by the control mechanism, so that every flat speaker can rotate at a different angle. In other words, sounds can be sent to the directions preset by the user as illustrated in FIG. 5A. Here, the flat speaker 510 rotates an angle 541, the flat speaker 511 rotates an angle 542, the flat speaker 514 rotates an angle 543, and the flat speaker 515 rotates an angle 544.

Figure 5B:
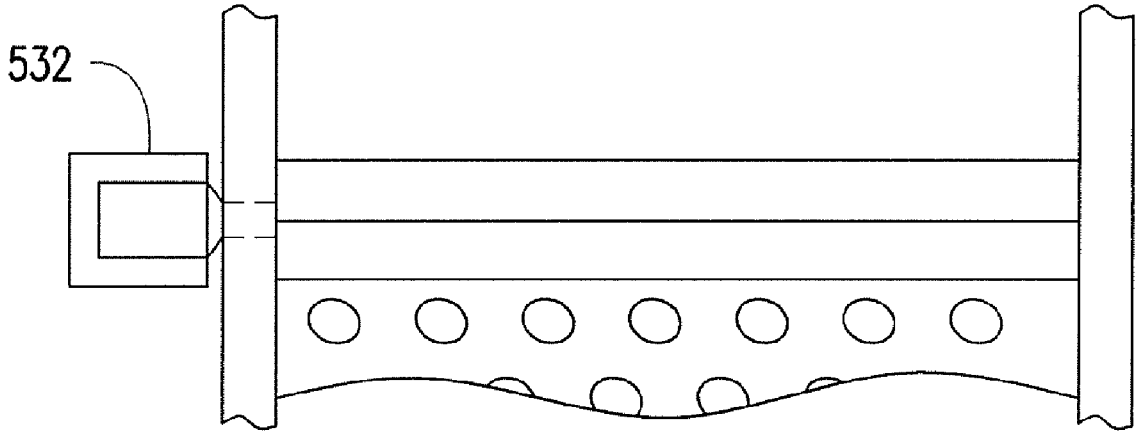
FIG. 5B is an enlarged diagram showing a part of FIG. 5A.

In order to achieve this goal, in one embodiment, a control mechanism 530 and a plurality of stepping motors 532 are respectively connected to the serial connection devices 520, 521, 522, 523, 524, and 525. Each of the serial connection devices 520, 521, 522, 523, 524, and 525 has, for example, gear wheels on two sides. Moreover, every gear wheel is engaged to a stepping motor 532 correspondingly, and driven by the stepping motor 532 to rotate. The driving circuit and the control mechanism 530 control each stepping motor 532 to rotate individually. FIG. 5B is an enlarged diagram of a connection between the stepping motor 532 and the serial connection device.

Figure 6A:
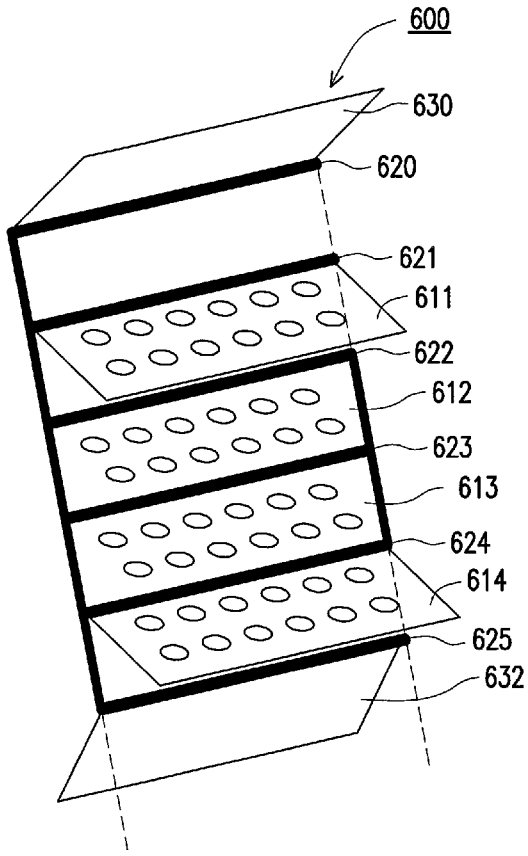
FIG. 6A is a schematic diagram of a multi-directional flat speaker device capable of adjusting angles individually and having baffle structures according to another embodiment.

In another embodiment of the multi-directional flat speaker device, not only a control mechanism can be utilized to control serially connected thin-type flat speakers to send sounds individually to directions preset by a user, but baffles can also be added, as illustrated in FIG. 6A, to enhance directional effects of the flat speakers. As illustrated in FIG. 6A, a multi-directional flat speaker device 600 includes a plurality of flat speakers with directional effects 611, 612, 613 and 614, for example, and surfaces thereof include a plurality of sound holes. A plurality of serial connection devices 620, 621, 622, 623, 624 and 625 is serially connected to a plurality of corresponding flat speakers 611, 612, 613 and 614 respectively so as to drive the serially connected flat speakers to rotate. In order to enhance the directional effects of the flat speakers, increase reflectivity of sounds, or prevent interferences between adjacent speakers, the multi-directional speaker device 600 is joined with baffles 630 and 632 for increasing the sound reflectivity or preventing the interferences between the adjacent speakers. The baffles 630 and 632 respectively include serial connection devices 620 and 625 for control mechanisms to control rotations thereof.

Figure 6B:
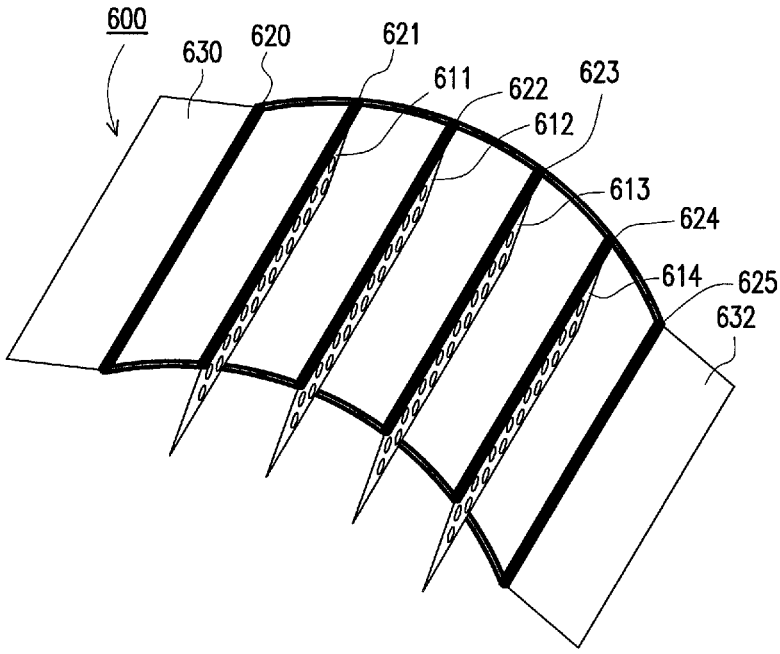
FIG. 6B is a schematic diagram of a different disposition design according to another embodiment.

A disposition of the serial connection devices 620, 621, 622, 623, 624 and 625 being serially connected to the corresponding flat speakers 611, 612, 613 and 614 can be disposed in a linear manner, an annular manner or a half-annular manner with a specific radian. The disposition is designed based on demands of actual products or different disposing locations of the multi-directional flat speaker devices. For instance, referring to FIG. 6B, the method of serially connecting the serial connection devices 620, 621, 622, 623, 624 and 625 utilizes the radian design of a half-annular.

Figure 7B:
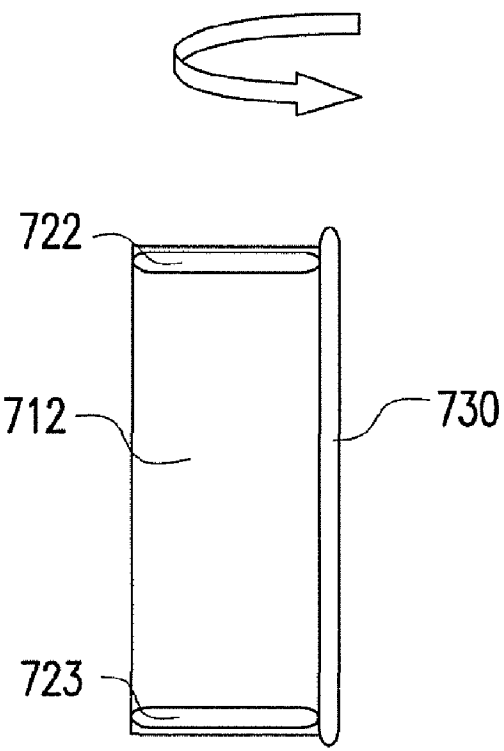
FIG. 7A and FIG. 7B are schematic diagrams of supporting structures of a flat speaker in a multi-directional flat speaker device provided in the embodiment.
Figure 7A:
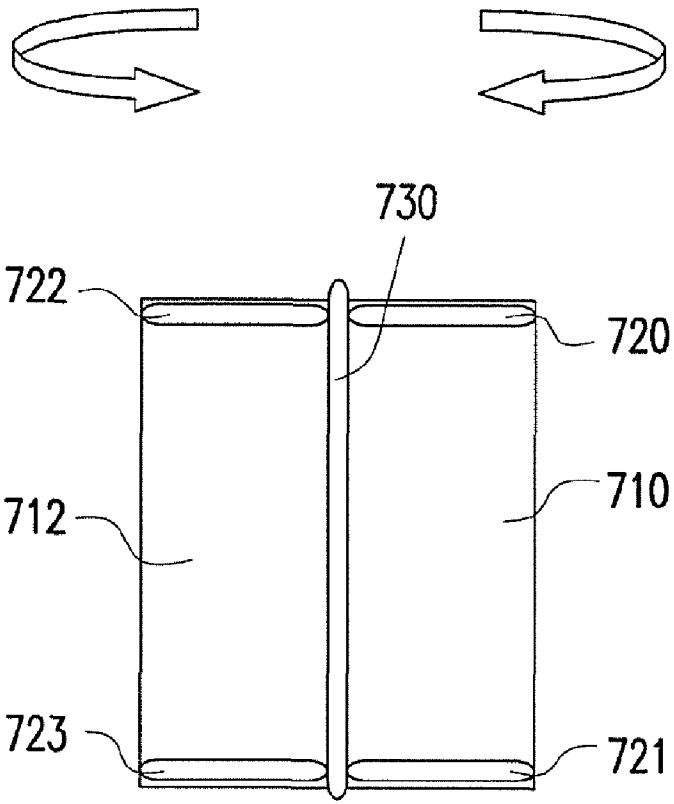

A supporting mechanism between the thin-type flat speakers and the serial connection devices can be disposed at an edge or a specific location of the flat speaker. For example, referring to FIG. 7A and FIG. 7B, supporting rods 720, 721 and 722, 723 are respectively located on two sides of flat speakers 710 and 712. A revolver 730 is controlled by a control mechanism, such that the flat speakers 710 and 712 can be rotated to different angles, for example, 0-180°, through the revolver 730. As shown in FIG. 7B, if the flat speaker 712 is present, then the two sides thereof include supporting rods 722 and 723. Hence, the flat speakers 722 and 723 can be rotated to different angles, for example, from 0 degree to 360 degrees, through the revolver 730.

Figure 8:
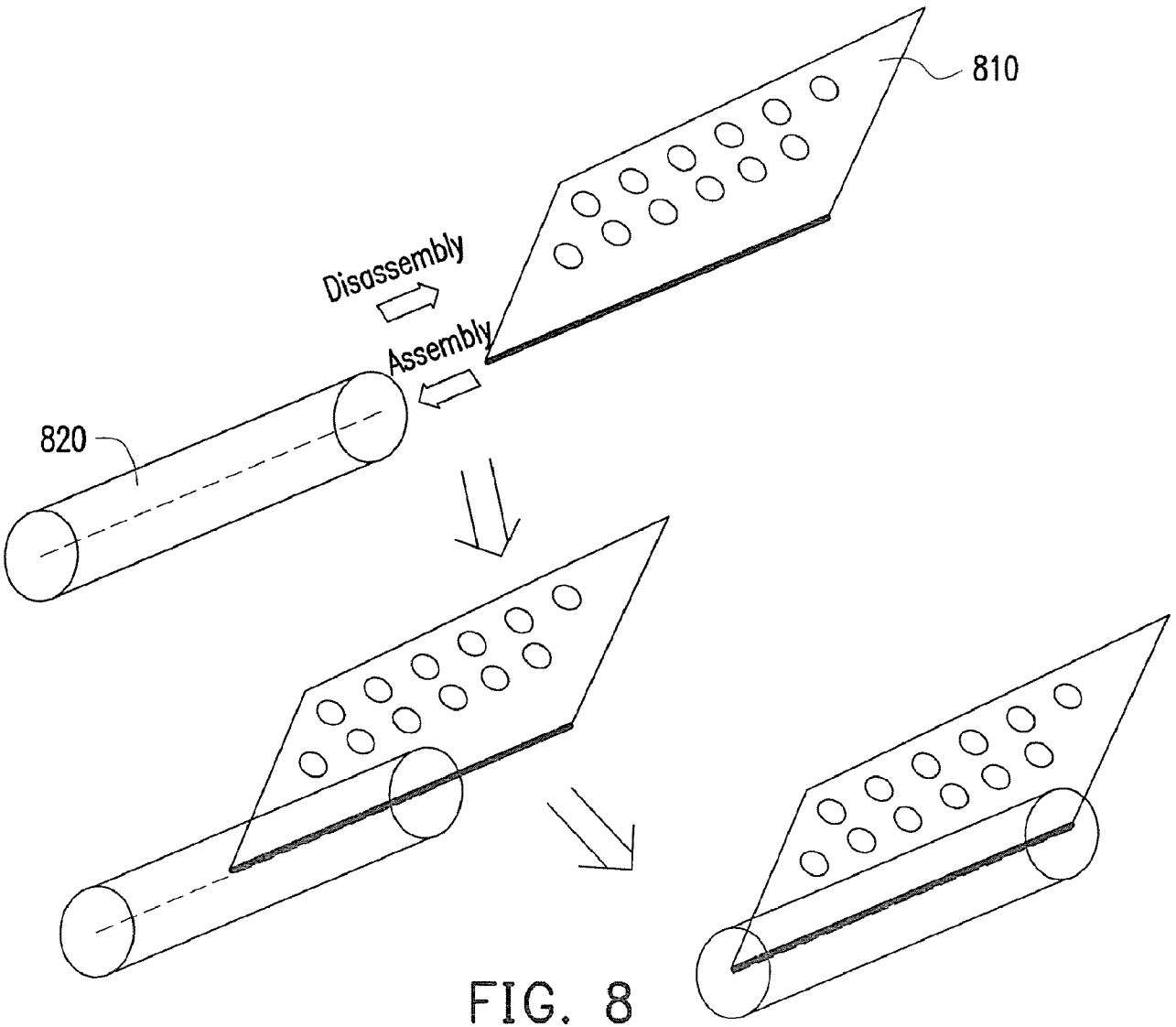
FIG. 8 is a schematic diagram of the assembly and disassembly of a flat speaker in a multi-directional flat speaker device provided in the embodiment.

In addition, an assembly of the flat speaker and the serial connection device can be referred to FIG. 8. The supporting mechanism utilizes an assembling method as illustrated in the diagram, or a mechanism fixing or bonding method to perform the assembly. A serial connection device 820 has a bar-shaped hole for inserting a flat speaker 810. The flat speaker 810 is slid into the bar-shaped hole from a side to be fixed or pulled out to be disassembled.

A control mechanism for controlling the thin-type flat speakers can control individual speakers to face a same direction or different directions. The control mechanism can be a method of assembling an electrical circuit and a mechanical mechanism, or simply a method of assembling a mechanical mechanism. In addition, a method of linking serial connected thin-type flat speakers can apply transmission lines for transmitting audio signals, or an external facilitating mechanism.

The multi-directional flat speaker device includes an audio input interface for receiving one or a plurality set(s) of audio signals. Herein, the audio signals can be identical signals or a plurality of processed divided signals that is provided to different flat speakers. Therefore, the flat speakers with directivity can be individually driven to output the processed divided signals from an audio end to different directions. Thus, a specific sound field effect design can be achieved.

Figure 9:
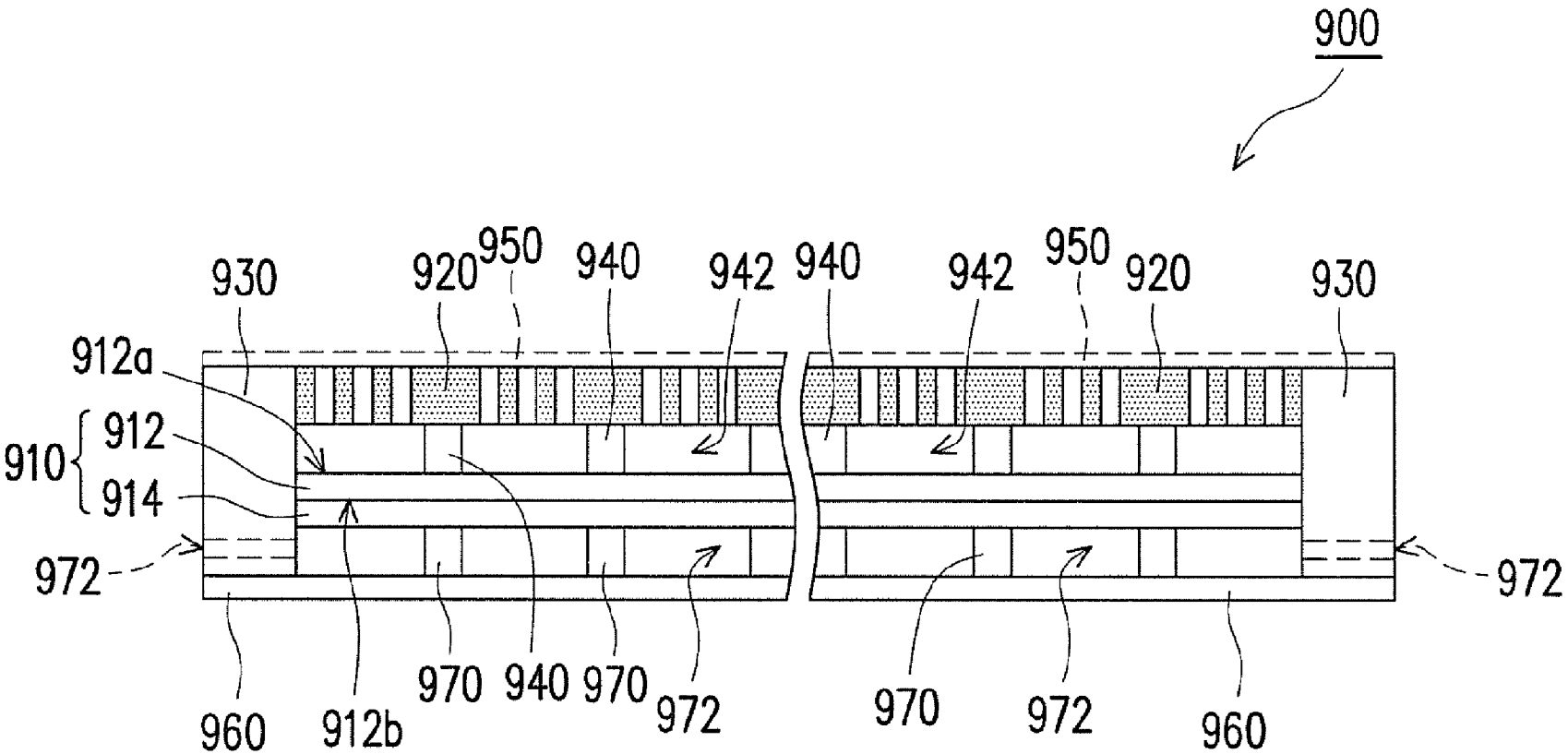
FIG. 9 is a schematic structural diagram of a flat speaker unit applied in a multi-directional flat speaker device provided in the embodiment.

Moreover, a structure of the flat speaker aforementioned, referring to FIG. 9, is assembled by a plurality of speaker unit structures 900 in one embodiment. The speaker unit structure 900 forms a working region of a vibrating film between adjacent supporting bodies on two sides, that is, a cavity space for the speaker to generate resonant sound field is formed. The interior of the speaker unit structure 900 is disposed with a plurality of specifically designed supporting bodies. Here, the supporting bodies are specifically designed for the configuration or the manner of disposition. Moreover, a design of a sound cavity structure provided in the embodiment faces the rear of the sound making direction. A working region of the vibrating film is formed between the sound cavity substrate and the vibrating film through the adjacent sound cavity supporting bodies, that is, another cavity space of the speaker for generating a resonant sound field is formed.

The speaker unit structure 900 includes a vibrating film 910, an electrode layer 920 with a plurality of holes, a frame supporting body 930, and a plurality of supporting bodies 940 between the electrode layer 920 and the vibrating film 910. A sound cavity structure is present on a side that is opposite to the side of the vibrating film 910 facing the electrode layer 920. The sound cavity structure is assembled by a sound cavity substrate 960 and a plurality of sound cavity supporting bodies 970, which is disposed between the vibrating film 910 and the sound cavity substrate 960. The vibrating film 910 includes an electret layer 912 and a metal thin film electrode 914. Herein, a side surface 912*a* of the electret layer 912 is connected to the frame supporting body 930 and the supporting bodies 940. Moreover, another side surface 912*b* is electrically connected to the metal thin film electrode 914.

The electrode layer 920 having a plurality of holes can be assembled by metal material. In one embodiment, flexible material, such as paper or ultra-thin non-conductive material layer, can also be applied by plating a layer of metal thin film on a surface thereof.

When the electrode layer 920 is a non-conductive material being plated with a layer of metal thin film, the non-conductive material can be non-conductive material such as plastic, rubber, paper, non-conductive fabric (cotton fiber, high polymer fiber), etc, and the metal thin film can be pure metal material such as aluminum, gold, silver, copper, an alloy thereof, bi-metal material such as Ni/Au, one of indium tin oxide (ITO) or indium zinc oxide (IZO) or a combination thereof, or high polymer conductive material PEDOT, etc.

In another embodiment, when the electrode layer 920 is assembled by conductive material, the electrode layer 920 can be assembled by one of metal (iron, copper, aluminum, etc, or an alloy thereof) and conductive fabric (metal fiber, metal oxide fiber, carbon fiber, graphite fiber).

A material of the electret layer 912 can be dielectric material. The dielectric material can maintain static charges for a long time after being electrized, and can generate ferroelectric effect therein after being charged, and is thus called the electret vibrating film layer. The electret layer 912 can be fabricated by mono-layer or multi-layer dielectric material, and the dielectric material can be, for example, fluorinated ethylenepropylene (FEP), polytetrafluorethylene (PTFE), polyvinylidene fluoride (PVDF), some Fluorine Polymer, and other suitable materials. Additionally, the interior of the dielectric material includes micro or micro nano-pores. The electret layer 912 is a vibrating film capable of maintaining the static charges and piezoelectricity for a long time after the dielectric material is electrized, and includes micro nano-pores to increase the transmittance and piezoelectric characteristics. Thus, after being charged by corona, dipolar charges are generated in the material to generate the ferroelectric effect. In order not to affect the tension and vibration effects of the vibrating film 910, the metal thin film electrode 914 may be an ultra-thin metal thin film electrode. The thickness of the defined "ultra-thin" herein is between about 0.2 μm (micrometer, μm) and 0.8 mm (millimeter, mm), and the preferred thickness is between about 0.2 μm and 0.4 μm in an embodiment, which may be approximately 0.3 μm.

The electret layer 912 that is fully injected with negative charges is set as an example for illustration. The input audio signals are respectively connected to the electrode layer 920 having the plurality of holes and the metal thin film electrode 914. When the input audio signal is a positive voltage, it generates an attractive force with the negative charges of the electret vibrating film on the speaker unit. When the audio signal is a negative voltage, it generates a repulsive force with the positive charges on the speaker unit, so as to cause the movement of the vibrating film 910.

On the contrary, when the voltage-phase input of the audio signal has changed, the positive voltage similarly generates an attractive force with the negative charges of the electret vibrating film on the speaker unit while the negative voltage generates a repulsive force with the positive charge on the unit, and the vibrating film 910 moves towards an opposite direction. When the electret vibrating film 910 moves towards different directions, it generates sound output by means of compressing the surrounding air.

As for the speaker unit structure 900 in this embodiment, a thin film 950 with air-permeable and water-proofing characteristics may be wrapped on one or two sides thereof, for example, GORE-TEX thin film made of expanded PTFE (ePTFE) material, which can prevent influences caused by water and oxidation that may result in the leakage of the charges of the electret layer 912 and thus affecting the ferroelectric effect.

A working region of the vibrating membrane 910 is formed between the electrode layer 920 and the vibrating membrane 910 through the adjacent supporting bodies 940, that is, a cavity space 942 of the speaker for generating a resonant sound field is formed. A working region of the vibrating membrane 910 is formed between the electrode layer 960 and the vibrating membrane 910 through the adjacent supporting bodies 970, that is, a cavity space 972 of the speaker for generating a resonant sound field is formed. No matter for the supporting bodies 940 or the sound cavity supporting bodies 970, the disposing manner, the height, and other designs may be adjusted according to the requirements on design. In addition, the number of the sound cavity supporting bodies 970 may be equal to, less than, or more than that of the supporting bodies 940. The supporting bodies 940 or the sound cavity supporting bodies 970 may be respectively fabricated on the electrode layer 920 or the sound cavity substrate 960.

The sound cavity structure provided in the embodiment is disposed on a surface of the metal thin film electrode 914 of the vibrating film 910. The optimal design of supporting bodies or material of disposing sound absorbing cotton are disposed according to the consideration of the frequency design of the speaker. Here, the disposing manner, the height, and other designs may be adjusted, and the configuration thereof can be of random shapes. Moreover, the cavity space formed by the frame supporting body at the location of the sound cavity structure may optionally include a sound releasing hole 972 for releasing the pressure from generating sounds to produce a better sound field effect.

It will be apparent to those skilled in the art that various modifications and variations can be made to the structure of the embodiment without departing from the scope or spirit of the invention. In view of the foregoing, it is intended that the embodiment cover modifications and variations of this invention provided they fall within the scope of the following claims and their equivalents.

What is claimed is:

1. A multi-directional flat speaker device, comprising:

a plurality of flat speakers having sound field directional characteristics;

a serial connection unit, configured to connect the plurality of flat speakers serially in a parallel manner; and a control unit, configured to control a rotation of one or more of the plurality of flat speakers respectively, and generating a directional sound field according to a rotation angle of the plurality of flat speakers; wherein the control unit controls each of the plurality of flat speakers to rotate a corresponding angle independently.

2. The multi-directional flat speaker device as claimed in claim 1, wherein the control unit controls the plurality of flat speakers to rotate a same angle.

3. The multi-directional flat speaker device as claimed in claim 1, wherein the serial connection unit comprises a plurality of serial connection devices, and each of the plurality of serial connection devices is configured to fix the corresponding flat speaker, and the rotation thereof is controlled by the control unit.

4. The multi-directional flat speaker device as claimed in claim 3, wherein the control unit drives the plurality of serial connection devices to rotate simultaneously through a transmission belt.

5. The multi-directional speaker device as claimed in claim 4, wherein each of the serial connection devices comprises a gear wheel connected to the transmission belt, and is configured to rotate as driven by the transmission belt.

6. The multi-directional flat speaker device as claimed in claim 5, wherein the control unit comprises:

a stepping motor, configured to drive the plurality of serial connection devices;

a driving circuit, configured to generate a control signal for the driving, so as to control the stepping motor;

a controller, configured to control the driving of the driving circuit; and a power managing unit, configured to control an operational power of the control unit.

7. The multi-directional speaker device as claimed in claim 3, wherein each serial connection device comprises a gear wheel connected to the control unit, and is configured to rotate individually by the control unit.

8. The multi-directional flat speaker device as claimed in claim 7, wherein the control unit comprises:

a plurality of stepping motors, each connected to one of the plurality of corresponding serial connection devices respectively for driving the serial connection device to rotate;

a driving circuit, configured to generate a control signal for driving, so as to control the plurality of stepping motors;

a controller, configured to control the driving of the driving circuit; and a power managing unit, configured to provide an operational power of the control unit.

9. A multi-directional flat speaker device as claimed in claim 1, wherein the plurality of flat speakers is connected to an audio input interface for receiving at least one set of audio signals.

10. A multi-directional flat speaker device as claimed in claim 1, wherein the plurality of flat speakers is connected to an audio input interface for receiving a plurality of sets of audio signals and transmitting the plurality of sets of audio signals optionally to the plurality of corresponding flat speakers.

11. The multi-directional flat speaker device as claimed in claim 1, wherein the plurality of flat speakers is connected to an audio input interface for receiving a plurality of processed divided signals, transmitting the plurality of processed divided signals via the serial connection unit to the plurality of appointed flat speakers each having a directional effect, and driving each of the plurality of flat speakers in cooperation with the control unit to transmit the plurality of processed divided signals, which is obtained from the audio input interface, to a specific direction.

12. The multi-directional flat speaker device as claimed in claim 1, wherein the device further comprises at least two baffles configured to be serially connected to the serial connection unit with the plurality of flat speakers in a parallel manner for reducing a sound interference sent by the plurality of flat speakers.

13. The multi-directional flat speaker device as claimed in claim 12, wherein the two baffles are respectively disposed on two sides of the plurality of flat speakers.

14. The multi-directional flat speaker device as claimed in claim 1, wherein the flat speaker comprises a plurality of speaker units, and the speaker unit comprises:

a vibrating film;

an electrode, having a plurality of holes, a sound cavity substrate;

a frame supporting body, being a stacked structure surrounding the electrode, the vibrating film, and the sound cavity substrate, and fixing the vibrating film between the electrode and the sound cavity substrate, wherein a first cavity space is formed between the electrode and the vibrating film, and a second cavity space is formed between the sound cavity substrate and the vibrating film;

a plurality of supporting bodies, located within the first cavity space and disposed between the electrode and the vibrating film for preventing a contact between the vibrating film and the electrode; and a plurality of sound cavity supporting bodies, located within the second cavity space, and disposed correspondingly to the location of each of the plurality of supporting body.

15. The multi-directional flat speaker device as claimed in claim 14, wherein the vibrating film comprises at least one electret layer and one conductive electrode layer.

* * * * *